US012653262B2

(12) United States Patent
Malmegård et al.

(10) Patent No.: US 12,653,262 B2
(45) Date of Patent: Jun. 16, 2026

(54) HELMETS WITH AUTOMATED SYSTEMS AND METHODS OF USING THE SAME

(71) Applicant: POC Sweden AB, Stockholm (SE)

(72) Inventors: Philip Åke Magni Malmegård, Stockholm (SE); Oscar Huss, Stockholm (SE); Johan Weman, Stockholm (SE)

(73) Assignee: POC Sweden AB, Stockholm (SE)

( * ) Notice: Subject to any disclaimer, the term of this patent is extended or adjusted under 35 U.S.C. 154(b) by 526 days.

(21) Appl. No.: 18/276,847

(22) PCT Filed: Feb. 14, 2022

(86) PCT No.: PCT/EP2022/053533
§ 371 (c)(1),
(2) Date: Aug. 10, 2023

(87) PCT Pub. No.: WO2022/171870
PCT Pub. Date: Aug. 18, 2022

(65) Prior Publication Data

US 2024/0130458 A1 Apr. 25, 2024
US 2024/0225166 A9 Jul. 11, 2024

Related U.S. Application Data

(60) Provisional application No. 63/200,114, filed on Feb. 15, 2021.

(51) Int. Cl.
*A42B 3/04* (2006.01)
*A42B 3/06* (2006.01)

(52) U.S. Cl.
CPC ..... *A42B 3/0466* (2013.01); *A42B 3/044* (2013.01); *A42B 3/062* (2013.01)

(58) Field of Classification Search
CPC ..... A42B 3/044; A42B 3/0446; A42B 3/0453; A42B 3/0466
See application file for complete search history.

(56) References Cited

U.S. PATENT DOCUMENTS 7,526,389 B2 4/2009 Greenwald et al.
8,322,188 B2 * 12/2012 Jeftic-Stojanovski .... F41H 1/04 73/780
10,217,345 B1 * 2/2019 Nanjappan ..... G08B 21/18
(Continued)

FOREIGN PATENT DOCUMENTS

CN 107529845 A * 1/2018 ..... B60Q 1/38
CN 105581411 A 3/2018
(Continued)

OTHER PUBLICATIONS

PCT International Search Report dated May 25, 2022, in International Application No. PCT/EP2022/053533.

*Primary Examiner* — Alexander K Garlen
(74) *Attorney, Agent, or Firm* — Downs Rachlin Martin PLLC

(57) ABSTRACT

Helmet-mounted systems (100) that may include lighting systems (102) and solar-powered battery systems (112), automated controls (116), and/or integrated sensors (104) that result in an automated and fully integrated systems that do not require user-initiated recharging of batteries or require a user to manually turn the components of the system on and off.

29 Claims, 10 Drawing Sheets

(56) References Cited

U.S. PATENT DOCUMENTS

Figure 1:
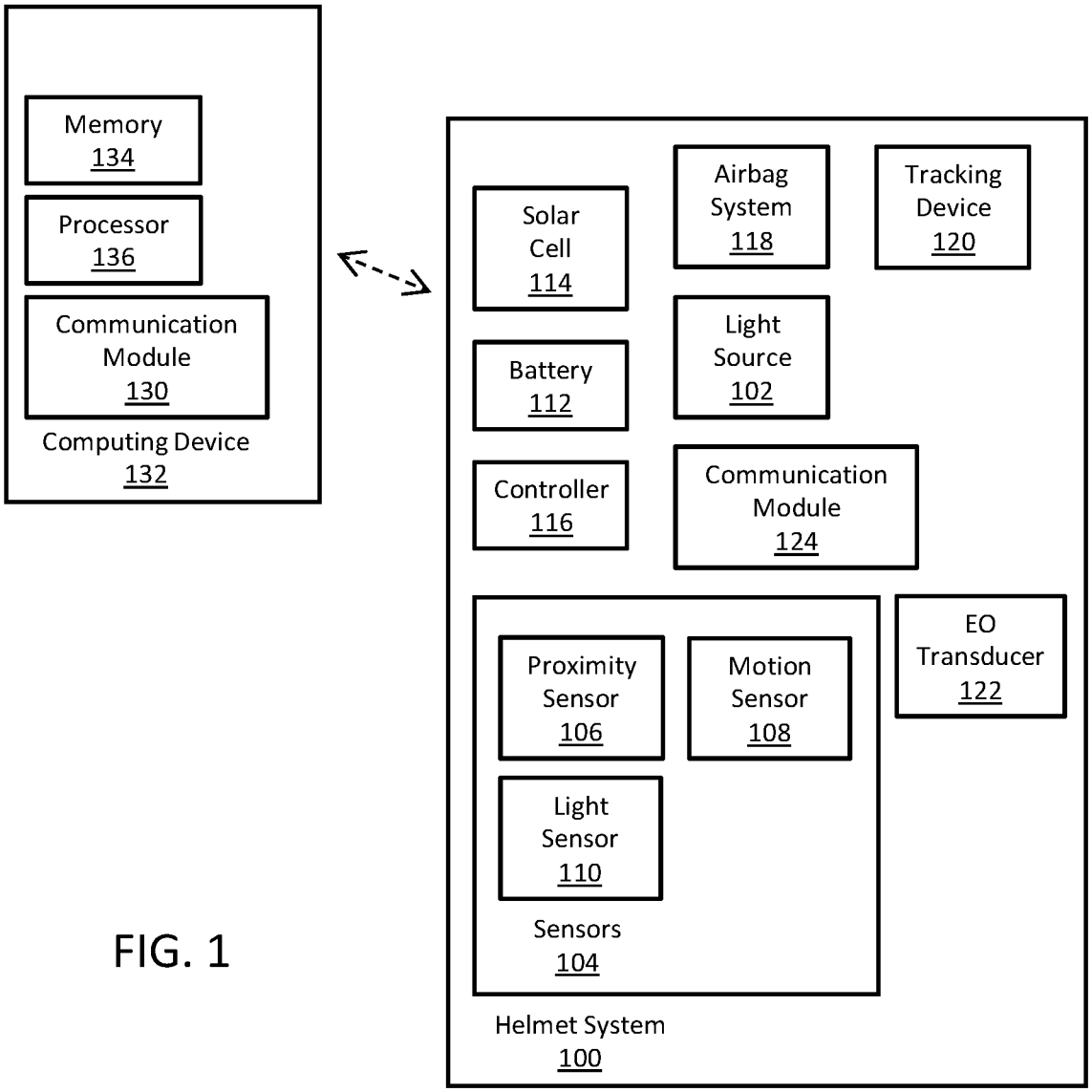

| | | | | |
|---|---|---|---|---|
| 10,631,587 | B2 * | 4/2020 | Bailey | A42B 3/0453 |
| 2005/0219837 | A1 * | 10/2005 | Brown | A42B 3/0446 362/105 |
| 2009/0303698 | A1 * | 12/2009 | Huss | A42B 3/0433 362/105 |
| 2012/0210498 | A1 | 8/2012 | Mack | |
| 2015/0374061 | A1 | 12/2015 | Hankes et al. | |
| 2018/0338557 | A1 | 11/2018 | Gallizzi | |
| 2021/0361018 | A1 * | 11/2021 | Fujiwara | G05B 19/048 |

FOREIGN PATENT DOCUMENTS

| | | | | |
|---|---|---|---|---|
| KR | 101731726 | B1 * | 4/2017 | A42B 3/00 |
| WO | 2011027369 | A1 | 3/2011 | |

* cited by examiner

HELMETS WITH AUTOMATED SYSTEMS AND METHODS OF USING THE SAME

RELATED APPLICATION DATA

This application claims the benefit of priority of U.S. Provisional Patent Application Ser. No. 63/200,114, filed on Feb. 15, 2021, and titled "Helmets With Automated Lighting Systems and Methods of Using the Same," which is incorporated by reference herein in its entirety.

FIELD OF THE DISCLOSURE

The present disclosure generally relates to the field of helmets. In particular, the present disclosure is directed to helmets with automated systems and methods of using the same.

BACKGROUND

Electrical devices and software are increasingly utilized in activities that also involve the use of a protective helmet, such as biking, skiing, public safety, and construction activities. For example, the use of personal lighting during sporting activities such as bicycling and skiing is an important component of safety for a number of reasons, including to make a person more visible to others, such as other bicyclists, skiers, or automobile drivers, to increase visibility for the person using the lighting, and to make obstacles with reflective surfaces more visible to the person using the lighting. Existing lighting systems, however, are often underutilized because they require a user to remember to regularly recharge the battery for the lights, due to cumbersome user controls, and/or because the lights are expensive and secured to only one bicycle, making it less likely a user with more than one bike will go through the trouble of purchasing more than one lighting system or moving the lights from one bike to another. The use of personal lighting is also important during construction work to make construction workers more visible to others, such as operators of trucks and other construction equipment. In addition to lighting systems, examples of other electrical devices and/or software elements that are increasingly utilized in activities that also involve the use of a protective helmet include helmet airbag systems, tracking devices, motion sensors, and data loggers, among others.

SUMMARY OF THE DISCLOSURE

In one implementation, the present disclosure is directed to a helmet. The helmet includes an energy absorbing layer having an inner surface; at least one electrical component coupled to the helmet; at least one capacitive proximity sensor electrode disposed proximate the inner surface of the energy absorbing layer; and a controller electrically connected to the at least one electrical component and the at least one electrode, the controller configured to generate an electric field at the electrode and receive a proximity sensor signal that detects when the helmet is being worn by detecting a change in the electric field caused by the presence of a user's head inside of the helmet, wherein the controller is configured to activate and deactivate the at least one electrical component according to the proximity sensor signal.

In another implementation, the present disclosure is directed to a method of controlling a helmet lighting system of a helmet with a controller embedded in the helmet according to instructions stored in a non-transitory computer readable storage medium. The instructions include providing an electrical current to an electrode of a capacitive proximity sensor to generate an electric field at the electrode, the electrode located proximate an inner surface of the helmet; receiving a proximity sensor signal that detects when the helmet is being worn by detecting a change in the electric field caused by the presence of a user's head inside of the helmet; turning a light source of the lighting system on in response to the proximity sensor signal indicating the presence of a user's head in the helmet.

DETAILED DESCRIPTION

Aspects of the present disclosure include helmet systems with automated controls and integrated sensors that result in automated and fully integrated electrical devices and/or software elements. In some examples, helmets of the present disclosure include proximity sensors and/or motion sensors configured to determine when a helmet is being worn and automatically activate or deactivate one or more electrical or software elements in response to determining a usage state of the helmet, e.g., whether or not the helmet is being worn. Aspects of the present disclosure include helmet-mounted lighting systems with solar-powered batteries that do not require user-initiated recharging of batteries or require a user to manually turn the lights on and off. In some examples, lighting systems of the present disclosure provide for easy to use lighting systems that are configured to be automatically activated when the helmet is in use, eliminating the need to remember to turn the lights on and off or the need for buttons or other control elements to control the lights. By eliminating cumbersome user requirements of prior lighting systems, the lighting systems of the present disclosure result in an increased likelihood a user will use the lights while performing work activities in a hazardous environment, such as construction work and/or sporting activities such as biking or skiing, thereby decreasing the likelihood of accidents and injury.

FIG. 1 is a functional block diagram of one example of a helmet system 100 made in accordance with the present disclosure. The helmet system 100 may be fully integrated into any of a variety of helmets known in the art, such as a bike helmet, ski helmet, construction safety helmet, hard hat, or climbing helmet, etc. The example system 100 includes at least one light source 102 configured to emit visible light of one or more colors, such as one or more of white, red, yellow, blue, or green, etc. The illustrated helmet system 100 also includes sensors 104 that may include one or more of a proximity sensor 106 and/or a motion sensor 108 for detecting when the helmet is being worn by a user and at least one light sensor 110 for determining ambient lighting conditions. The helmet system also includes a battery 112 that provides electrical energy for powering the components of the system and at least one photovoltaic cell 114, also referred to herein as a solar cell, that is integrated into a helmet for recharging the battery. The helmet system 100 also includes at least one controller 116 for controlling the components of the helmet system, including controlling the light source 102 and battery 112 according to signals received from the sensors 104.

In some examples the controller 116 is a microcontroller that includes one or more components (not illustrated) known in the art of microcontrollers such as a microprocessor, memory, analog input and outputs, internal clocks, the memory containing instructions for causing the microprocessor to perform methods of controlling the components of the helmet system according to the present disclosure. In one example, the controller 116 is configured to turn the light source 102 on in response to a signal from the proximity sensor 106 indicating the helmet is being worn and turn the light source off when the proximity sensor indicates the helmet is not being worn, thereby conserving battery power. In some examples, the helmet system 100 does not include an external charging port for recharging the battery and does not include any user control elements such as buttons or switches, including any user control elements for turning the light source on and off, thereby providing an automated, seamless, and easy to use system that does not require any user intervention to maintain battery charge or to turn the lights on, other than to place the helmet on the user's head. In other examples, a helmet system made in accordance with the present disclosure may not include a solar cell and whether a solar cell is included or not, the helmet may include an electrical charging port for charging the battery 112 from another electrical source, and in some examples, the helmet may include replaceable batteries. Further, in some examples, the helmet may also include user control elements such as buttons or switches for controlling one or more electrical components of the helmet.

The illustrated helmet system 100 also includes an airbag system 118 that may include an airbag and an inflation module (not illustrated) for inflating the airbag in response to detecting an event that could lead to an impact and/or detecting an impact. The helmet system 100 may also include a tracking device 120 for tracking a current location of the helmet, with, for example, a GPS module (not illustrated) located in the helmet or another device proximate the helmet operably coupled to the tracking device. The helmet system 100 may also include one or more electroacoustic transducers 122, such as speakers or microphones for converting electrical signals to audio signals via air pressure waves (e.g. traditional speakers or headphones) or bone conduction (e.g. bone conduction headphones). Example implementations of the helmet systems disclosed herein may include any combination of one or more of the electrical components disclosed herein, or additional or alternate electrical components known in the art. For example, a helmet made in accordance with the present disclosure may include a proximity sensor 106 for determining when the helmet is being worn and at least one electrical component that is activated in response to the proximity sensor indicating the helmet is being worn and deactivated in response to the proximity sensor indicating the helmet is not being worn, wherein the at least one electrical component includes one or more of a light sensor, motion sensor, solar cell, airbag system, light source, tracking device, crash detection system, data logger, electroacoustic transducer, or any of a variety of other electrical components known in the art.

In some examples, the helmet system 100 also includes a communication module 124 configured for wired or wireless communication with a corresponding communication module 130 of a computing device 132, such as a mobile phone or laptop, for controlling or configuring the helmet system and for direct communication with communication modules of other devices, including other helmets, such by a wireless communication protocol over a mesh network of two or more connected helmets or other wireless communication capable devices. The communication modules 124, 130 may include at least one transceiver or equivalent component and may be configured for wireless communication using any wireless communication technology and protocol known in the art, such as Bluetooth, ZigBee, NFC, Wi-Fi, or RFID, etc. In one example, the helmet system 100 is configured to send an activation signal to the computing device 132 in response to the proximity sensor 106 generating a signal indicating the helmet is being worn and a deactivation signal in response to the proximity sensor signal indicating the helmet is not being worn. The computing device 132 may include instructions stored in memory 134 for receiving the activation and/or deactivation signal and for causing a processor 136 and/or other components of the computing device to perform an operation in response, where the operation may include activating and/or deactivating one or more software applications, such as an activity tracker application, music application, etc.

The solar cell 114 may include any of a variety of types and configurations of solar cells known in the art and is a solid state electrical device configured to convert energy from light incident on the solar cell directly to electrical energy. The solar cell 144, controller 116 and/or battery 112 also include circuitry such as a voltage boost circuit for transmitting and storing the electrical energy in the battery. For example, the solar cell 114 may be one or more of an amorphous silicon solar cell (a-Si), a cadmium telluride solar cell (CdTe), a copper indium gallium selenide solar cell (CI(G)S), a crystalline silicon solar cell (c-Si), a dye-sensitized solar cell (DSSC), a gallium arsenide germanium solar cell (GaAs), a micromorph (tandem-cell using a-Si/μc-Si), a monocrystalline solar cell (mono-Si), a multi junction solar cell (MJ), a nanocrystal solar cell, an organic solar cell (OPV), a perovskite solar cell, a polycrystalline solar cell (multi-Si), a quantum dot solar cell, and/or a thin-film solar cell (TFSC). In one example, the solar cell 114 is a DSSC solar cell having one or more aspects described in U.S. patent application Ser. No. 16/244,237, filed on Jan. 10, 2019 and titled, "Dye-sensitized solar cell unit and a photovoltaic charger including the solar cell unit," which is incorporated by reference herein in its entirety.

The light source 102 may include any of a variety of types and configurations of light sources known in the art, including any type of solid-state lighting, including light-emitting diodes (LEDs), organic light-emitting diodes (OLED), and/or polymer light-emitting diodes (PLED).

The proximity sensor 106 may include any of a variety of types and configurations of proximity sensors known in the art. For example, the proximity sensor 106 may include one or more of an inductive, capacitive, photoelectric, and/or ultrasonic proximity sensor that includes at least one sensing element located on or proximate the interior of a helmet that is designed to detect the presence of a user's head in the helmet for determining when the helmet is being worn. In one example, the proximity sensor includes a non-contact inductive proximity sensor that includes a ferrite core with coils, an oscillator, and an output amplifier, the inductive sensor configured to detect a ferrous target, where a distance between the ferrous target and the sensor changes when the helmet is placed on a user's head.

In another example, the proximity sensor 106 includes a capacitive proximity sensor which may include at least one sensing element such as a cable and/or plate positioned proximate an inner surface of a helmet. A capacitive sensor detects the presence of a user's head proximate the sensing element by directly or indirectly measuring a capacitance that changes in response to a change in materials (e.g., a user's head) proximate the sensing element. The sensing element may be made from a variety of materials, such as copper, indium tin oxide (ITO), and/or printed ink, or an alloy of any of the foregoing or other conductive materials. In one example, the at least one sensing element is/are linked to an oscillator, an AC source, and/or a resistor. In one example, the sensing element is connected to a resistor and a pin of a microcontroller configured for capacitive sensing. By way of example, an 8-bit microcontroller manufactured by Microchip, model number ATtiny1616 with pins configured for a capacitive touch sensor or an equivalent may be used.

In one example, the capacitive sensor is a self-capacitive design that includes a sensing element in the form of an electrode formed from a single wire or plate encased in an insulator that is disposed proximate an inner surface of a helmet. As used herein, the term plate in sensing plate, unless indicated otherwise, does not imply a particular thickness. Example implementations of sensing plates made in accordance with the present disclosure may be formed from a foil or sheet of material, for example, a flexible thin metal foil. A user's head interacts with the electric field emitted by the electrode causing the capacitance measured by the controller to change. In another example, the capacitive sensor is a mutual capacitive design that includes a sensing element formed from two electrodes that together form a capacitor that are disposed proximate an inner surface of a helmet. A user's head interacts with the electric field generated by the two electrodes causing the measured capacitance to change. With either a self-capacitive or mutual-capacitive design, the sensing element may include a shielding element located between an outer surface of the sensing element and an outer surface of a helmet to prevent objects located outside of the helmet from affecting the measured capacitance of the sensor to thereby prevent a false indication the helmet is being worn.

In another example, the proximity sensor includes a photoelectric sensor that includes an emitter light source and a photodiode or phototransistor receiver to detect emitted light, and supporting electronics, the emitter and receiver operatively coupled to an inner surface of a helmet and configured to detect the presence of a user's head. In another example, the proximity sensor is an ultrasonic proximity sensor and includes a sonic transducer operatively coupled to an inner surface of a helmet and configured to detect the presence of a user's head.

The motion sensor 108 may include any of a variety of types and configurations of motion sensors known in the art that may be used to detect when the helmet is being worn by detecting a movement of the helmet. For example, the motion sensor may include one or more of an accelerometer, a gyroscope, a digital compass, magnetometer, or an inertial measurement unit (IMU) containing one or more of the foregoing types of motion sensors. In one example, the controller is configured to use sensor signals generated by the motion sensor in conjunction with sensor signals generated by the proximity sensor to determine if the helmet is being used. In another example, the helmet may only include motion sensors and not include the proximity sensor for determining when the helmet is in use. The controller may also be configured to use the motion sensor signals to detect when an accident has occurred and may also be configured to generate and send an accident signal, via the communication module, when an accident has occurred.

The light sensor 110 may include any of a variety of types and configurations of light sensors known in the art. For example, the light sensor may include one or more photoresistors, photodiodes, and/or phototransistors. In one example, the light sensor 110 and the light source 102 are both LEDs, with one or more of the LEDs used as the light sensor. Utilizing one or more LEDs within a lighting device as a light sensor results in a simplified design that does not require a separate dedicated light sensor that is separate and apart from the light source.

Figure 2:
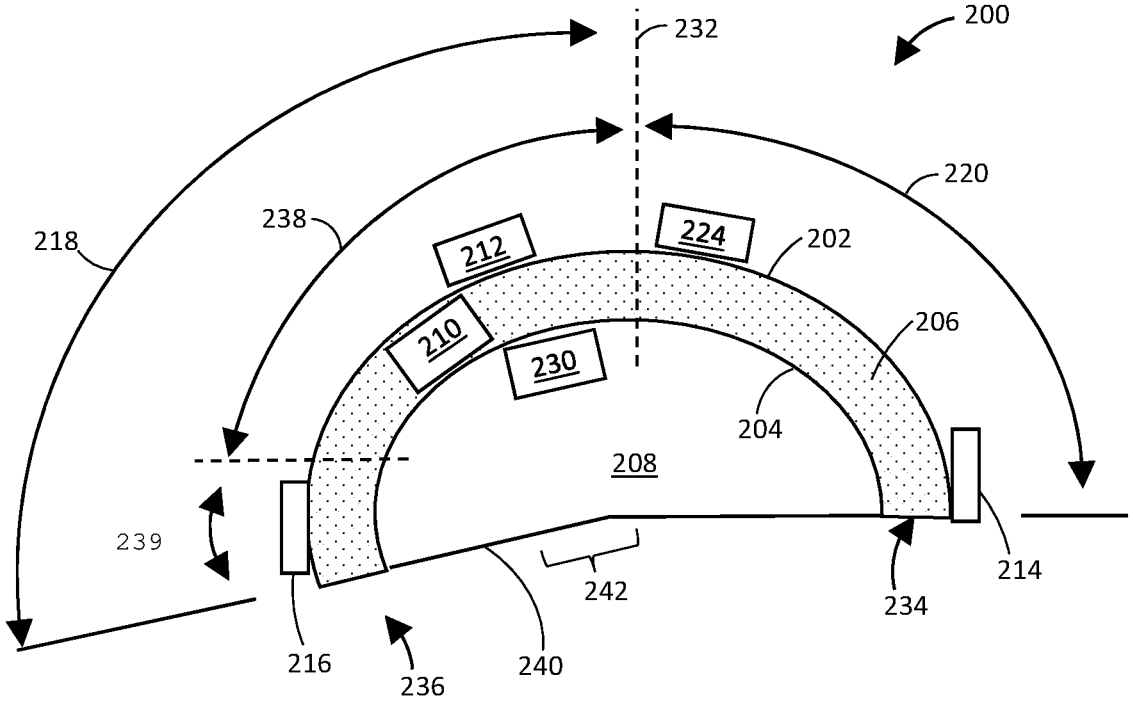

FIG. 2 is a cross-sectional side view of one example implementation of a helmet 200 and lighting system made in accordance with the present disclosure. In the illustrated example, the helmet 200 includes an outer surface 202, an inner surface 204, and one or more inner layers 206 therebetween where the inner layers may include at least one energy absorbing layer, the inner surface defining an interior volume 208 designed to receive a portion of user's head. The helmet 200 may have any combination of constructions and materials known in the art of helmets and according to the particular use, such as biking or skiing, the helmet is designed for. For example, the outer surface 202 may be defined by an outer shell constructed from one or more of polycarbonate, fiberglass, carbon fiber and Kevlar. The inner layers 206 may include one or more layers of energy absorbing materials, such as EPS or Koroyd. The inner surface 204 may include one or more components known in the art for providing comfort and fit, such as comfort padding and an adjustable fit system (not illustrated in FIG. 2). The foregoing is provided by way of example. Persons having ordinary skill in the art, after reading the present disclosure will recognize that sensor systems made in accordance with the present disclosure may be incorporated into any type of helmet or headwear, as well as other articles of clothing such as shirts, pants, jackets, gloves, etc.

FIG. 2 shows an example helmet system 200 which is an example implementation of helmet system 100 of FIG. 1, with like-named components of system 200 being an example implementation of the correspondingly-named component of helmet system 100. In the illustrated example, helmet 200 includes at least one interior module 210 fully or partially disposed in the inner layers 206, where the interior module may include one or more of the battery 112, controller 116, and communication module 124 of the system illustrated in FIG. 1. The helmet 200 includes at least one solar cell 212, at least a portion of which may be disposed on the outer surface 202 of the helmet. Helmet 200 also includes at least one light source 214 at least a portion of which may be disposed on the outer surface 202. In the illustrated example, one rear light source 216 is disposed on a rear portion 218 of the helmet and light source 214 is disposed on a front portion 220 of the helmet, however, this is shown by way of example and any number of light sources may be included at any location on the helmet. In the illustrated example, the helmet 200 also includes a light sensor 224 at least a portion of which may be disposed on the outer surface 202 that is separate from the solar cell 212 and light sources 214, 216. In other examples, a light sensor may be incorporated into the solar cell 212 and/or one or more of the light sources 214/216 instead of or in addition to a separate light sensor 224.

The illustrated example also includes at least one proximity sensor 230 disposed on the inner surface 204 and/or disposed in the inner layers 206 proximate the inner surface. The proximity sensor 230 is designed and configured to sense the presence of a user's head for determining when the helmet is being worn by a user. In some examples, the proximity sensor 230 is designed to maximize reliability and minimize false readings under a variety of conditions and for a variety of users. For example, the proximity sensor 230 may be designed and configured to not be affected by moisture, such as from sweat or rain, may be designed to not provide a false presence signal when the helmet is being held in a user's hand(s) rather than being worn, and may be configured to accurately detect the presence of a user's head for a variety of head shapes, including narrow and wide head shapes. As described more below, in some examples, the controller 116 may be configured to execute one or more algorithms to process proximity sensor signals to remove false signals that the helmet is being used. The algorithms may include algorithms to detect when the proximity sensor indicates the helmet has been worn for a long period of time, such as over one hour, indicating the proximity sensor reading may not be accurate.

In the illustrated example, the helmet includes a front portion 220 that extends from a lateral midplane 232 of the helmet 200 to a front end of the helmet and a rear portion 218 that extends from the lateral midplane 232 to a rear end 236 of the helmet, the lateral midplane located at a midpoint between the front and rear ends. The rear portion 218 includes a parietal portion 238 that extends in a rearward direction from the midplane 232 of the helmet that is designed to cover and be adjacent to a parietal portion of a user's head, and an occipital portion 239 located between the rear end 236 and the parietal portion 238 that is designed to cover and be adjacent to an occipital portion of a user's head. In the illustrated example, at least at portion of the at least one proximity sensor 230 is selectively located between the midplane 232 and the rear end 236, and in some examples located in the parietal portion 238 of the helmet for improved accuracy and reliability and to minimize false positive readings due to the helmet being held in one or two hands and also to ensure accuracy for a range of user head shapes. For example, locating the proximity sensor 230 in the parietal portion of the helmet may provide more accurate proximity sensor readings for users with narrow heads. In some examples, the at least one proximity sensor 230 is located proximate a forward-rear or longitudinal midplane of the helmet to increase accuracy, the longitudinal midplane extending between the front end and rear end and located at a midpoint between the left side and the right side of the helmet. In some examples, the at least one proximity sensor 230 includes a pair of sensors located in the parietal portion 238 on opposite sides of the longitudinal midplane of the helmet.

In the illustrated example, the helmet 200 also includes a lower edge 240, the lower edge including an ear portion 242 that is configured and dimensioned to be located substantially directly above a user's ear when the helmet is in use. In some examples, the at least one proximity sensor 230 is disposed in the helmet at a location that is approximately directly above the ear portion 242 of the lower edge 240 of the helmet such that the proximity sensor is configured and dimensioned to be located substantially directly above a user's ears when the helmet is in use. For example, at least a portion of the proximity sensor, such as at least a portion of the electrode of the proximity sensor is located along an axis that extends along an inner surface of the helmet between the ear portions 242 on the left and right sides of the helmet. A distance along the inner surface 204 of the helmet between the ear portion 242 of the lower edge 240 of the helmet and the proximity sensor 230 may be between approximately 25 mm to approximately 90 mm and in some examples approximately 40 mm to approximately 80 mm, and in some examples approximately 70 mm.

Figure 3A:
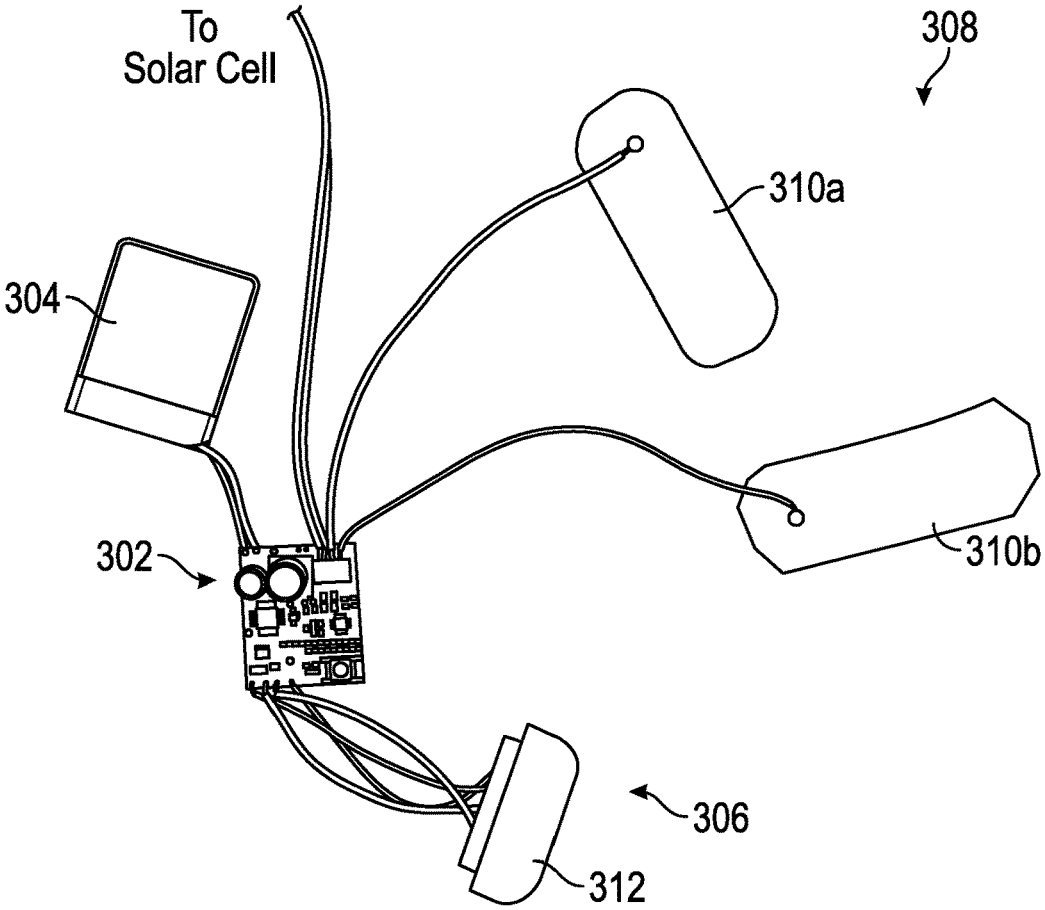

FIG. 3A illustrates one example implementation of a portion of the helmet system 100 of FIG. 1 and includes a controller 302 that includes a printed circuit board (PCB) and a microprocessor, memory, and other components known in the art of microcontrollers disposed on the PCB, the controller communicatively coupled to a battery 304, a solar cell (not illustrated), a lighting module 306 that, in the illustrated example, is a combination light source and light sensor and a proximity sensor 308. In the illustrated example, the proximity sensor 308 is a capacitive sensor and includes two sensing elements in the form of two sensing plates 310*a*, 310*b* that are each electrically coupled to the controller 302 and that are utilized by the controller to acquire two independent measurements that directly or indirectly measure capacitance which are used as proximity signals. Each sensing plate 310 is a self-capacitive design with each sensing plate forming a single electrode. In other examples, one or both of the sensing plates 310 may have a mutual capacitive design, and each may include a pair of spaced electrodes. In the illustrated example, the sensing plates 310 are formed from copper. Each of the sensing plates are designed to be encased in or between one or more insulators (not illustrated in FIG. 3A) and disposed on the inner surface of a helmet (e.g. inner surface 204, FIG. 2) or disposed in the inner layers (e.g. inner layers 206, FIG. 2) of a helmet proximate the inner surface, for sensing the presence of a user's head. In one example, an energy absorbing layer of a helmet acts as the insulator and the sensing plates 310 are directly embedded in the energy absorbing layer. In another example, the sensing plates 310 are disposed on an inner surface of the energy absorbing layer and covered by a sheet of insulating material, such as a sheet of polycarbonate, to electrically isolate the electrode (see, e.g., FIG. 3B). The sensing plates 310 may have a variety of shapes and dimensions. In some examples, they may have a thickness in the range of approximately 0.1 mm to approximately 2 mm and in some examples between 0.5 mm and 1 mm, and in some examples, less than 2 mm, and in some examples, greater than 0.5 mm. In some examples, the sensing plates have a shape that is approximately the same as a shape of an inner surface of a helmet in a region where the plates are designed to be located.

In the example shown in FIG. 3A, the lighting system includes only one lighting module 306 that includes a plurality of light emitting elements and at least one ambient light sensor, where the light emitting elements and light sensor are disposed in a common housing 312, at least a portion of the housing being transparent or translucent to allow the transmission of light generated by the light emitting elements. In the illustrated example, the lighting module 306 includes a plurality of LEDs configured to emit visible light and at least one LED designed and configured as an ambient light sensor.

Figure 3B:
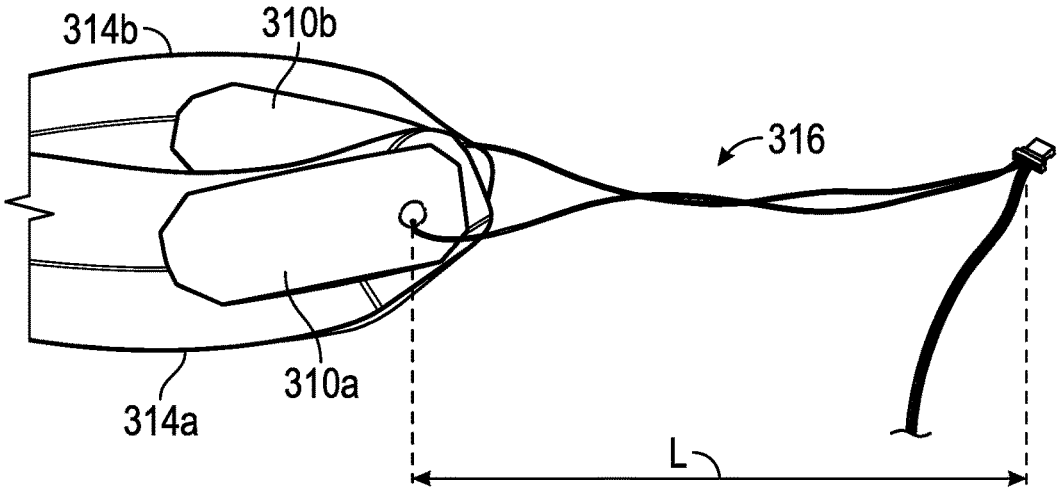

FIG. 3B shows a pair of capacitive sensing plates 310 coupled to corresponding insulating covers 314*a*, 314*b* for encasing the sensing plates on an inner surface of the helmet. In one example, each of the capacitive sensing plates 310 is a metal foil that is adhered to a corresponding sensing plate cover 314, and the combined sensing plate cover and metal foil are adhered to an inner surface of a helmet. FIG. 3B shows a top side of the sensing plates 310 that are configured to face an inner surface, such as an inner surface of an energy absorbing layer, of the helmet, the opposing bottom side of each sensing plate designed to face an interior of the helmet and a user's head when the helmet is in use. The sensing plate covers 314 may be formed from any insulating material. In the illustrated example, the sensing plate covers are each a sheet of polycarbonate. In other examples the sensing plates 310 may be covered by tape, adhesive and/or a sticker. In the illustrated example the sensing plates 310 have an outer shape that is complementary to a shape of a recess on an interior of the helmet for disposing the capacitive sensing plate 310 and cover 314 in the recess of the interior of the helmet. In some examples, the sensing plate 310 and cover 314 are configured to be disposed in a recess and configured to not come into direct physical contact with a user's head and are configured to detect the presence of a user's head when the user's head is positioned in the helmet and a top surface of the user's head is spaced from and not in direct physical contact with the sensing plate and/or sensing cover. (See FIG. 8B for one example of the sensing plates 310 and covers 314 disposed in a recess of an interior of a helmet.) The sensing plate covers 314 are designed to hide and protect the sensing plates 310 while locating the sensing plates close to the inner surface of the helmet and to provide a moisture barrier to prevent moisture from coming into contact with the sensing plate. FIG. 3B also shows electrical wires 316 electrically coupled to the sensing plates 310 for transmitting a proximity sensor signal to the controller 302 (FIG. 3A). The wires 316 may have a length, L, in the range of 5 cm to 20 cm and in some examples, 10 cm to 15 cm, and in some examples, approximately 12.5 cm.

Figure 4:
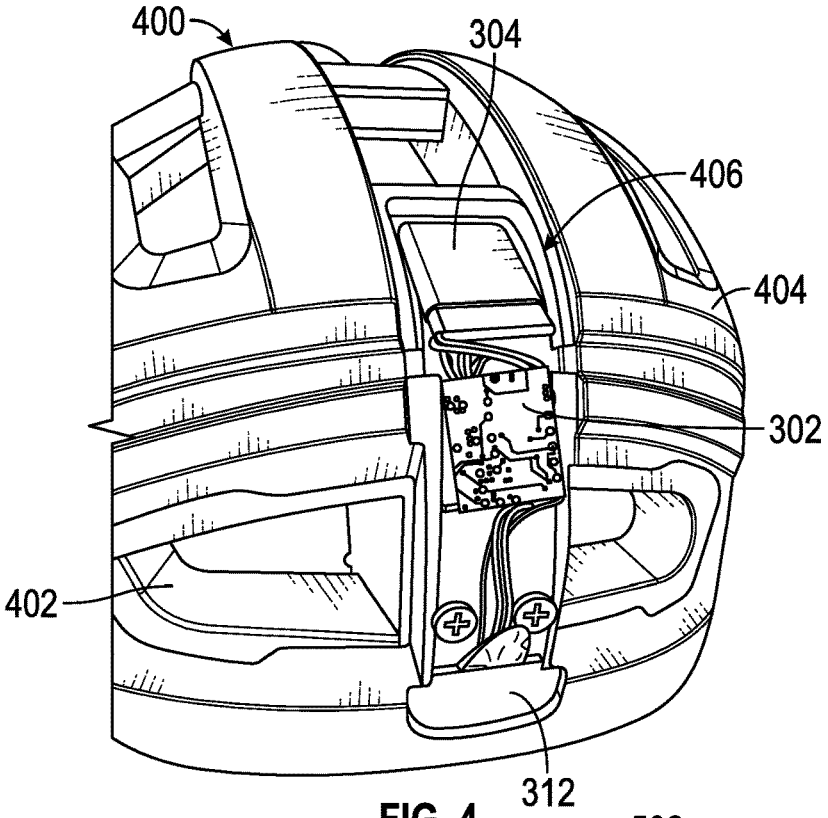
Figure 5:
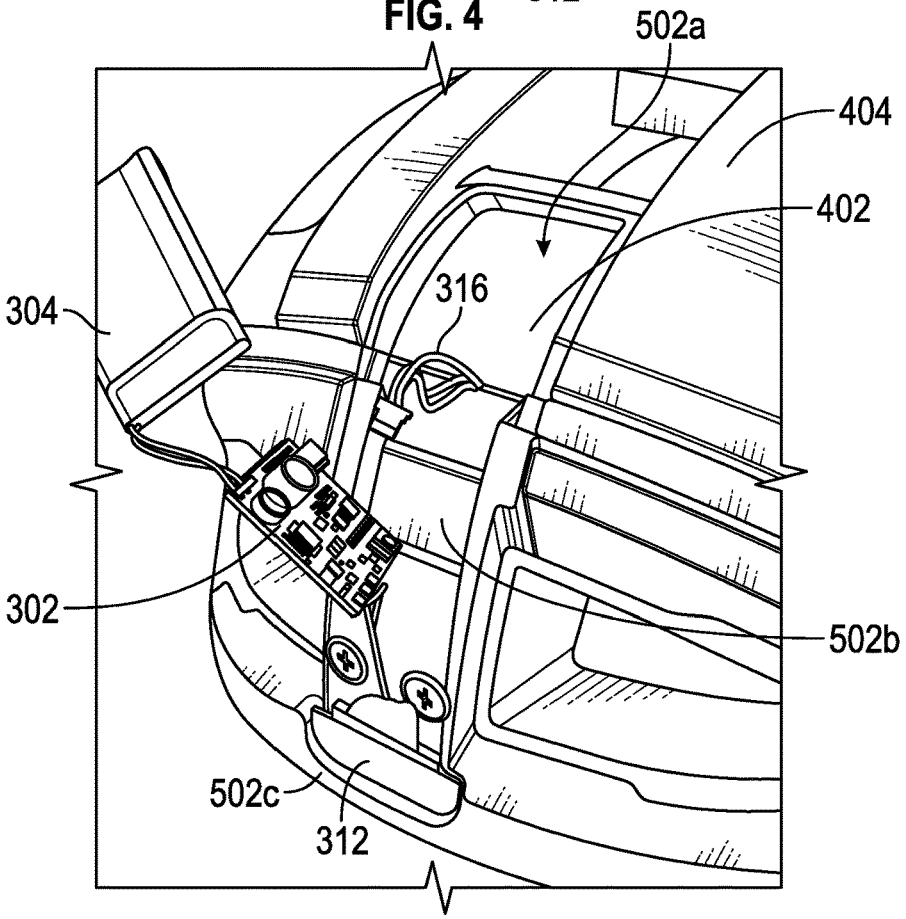

FIGS. 4 and 5 show one example implementation of the lighting system of FIGS. 3A and 3B with an example bike helmet 400. As shown in FIGS. 4 and 5, the bike helmet 400 includes a plurality of recesses 502 on a rear outer portion of an energy absorbing layer 402, which in the illustrated example is EPS foam, the recesses configured and dimensioned to receive components of the lighting system. The outer shell 404 of the helmet, here polycarbonate, also includes openings 406 that are configured and dimensioned to align with the recesses 502 in the energy absorbing layer 402 and receive lighting system components. In the illustrated example, the helmet includes a battery recess 502*a* located in the parietal portion of the helmet and designed to receive the battery 304, a controller recess 502*b* designed to receive the controller 302, and a lighting module recess 502*c* located in the occipital portion and designed to receive the lighting module 306. FIG. 4 shows the battery 304, controller 302, and lighting module 306 disposed in corresponding recesses 502 and FIG. 5 shows the battery 304 and controller 302 removed from the recesses 502 and also shows proximity sensor wires 316 extending through the energy absorbing layer 402 from the outer surface to the sensing plates 310 (not shown in FIGS. 4 and 5). In the illustrated example, the proximity sensor wires 316 extend though the energy absorbing layer 402 at a location between the battery recess 502*a* and the controller recess 502*b* in the parietal portion of the helmet.

Figure 6:
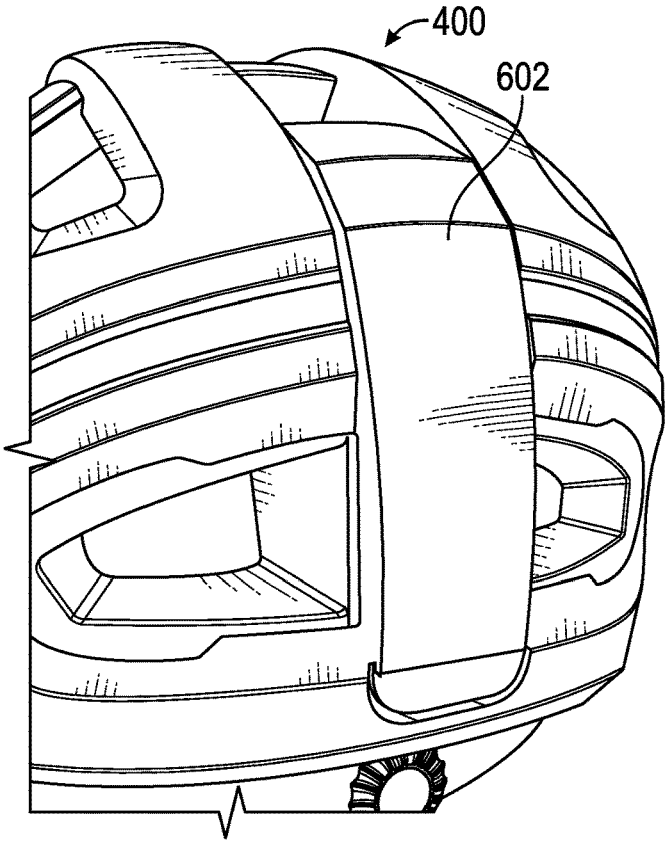

FIG. 6 is a rear perspective view of the helmet 400 showing the lighting system installed and a removable cover 602 disposed over the battery 304, controller 302 and associated wiring. In the illustrated example, the cover 602 is removeable and designed with a snap fit and is formed from a rigid material, for example, the same material as the outer shell, such as polycarbonate. The cover 602 may include a waterproof seal and designed to normally not be removed to ensure the interior components of the lighting system are not exposed to moisture. In other examples, the outer shell 404 of the helmet may be unitary and not include a removeable cover so that the lighting system is fully embedded and not accessible.

Figure 7:
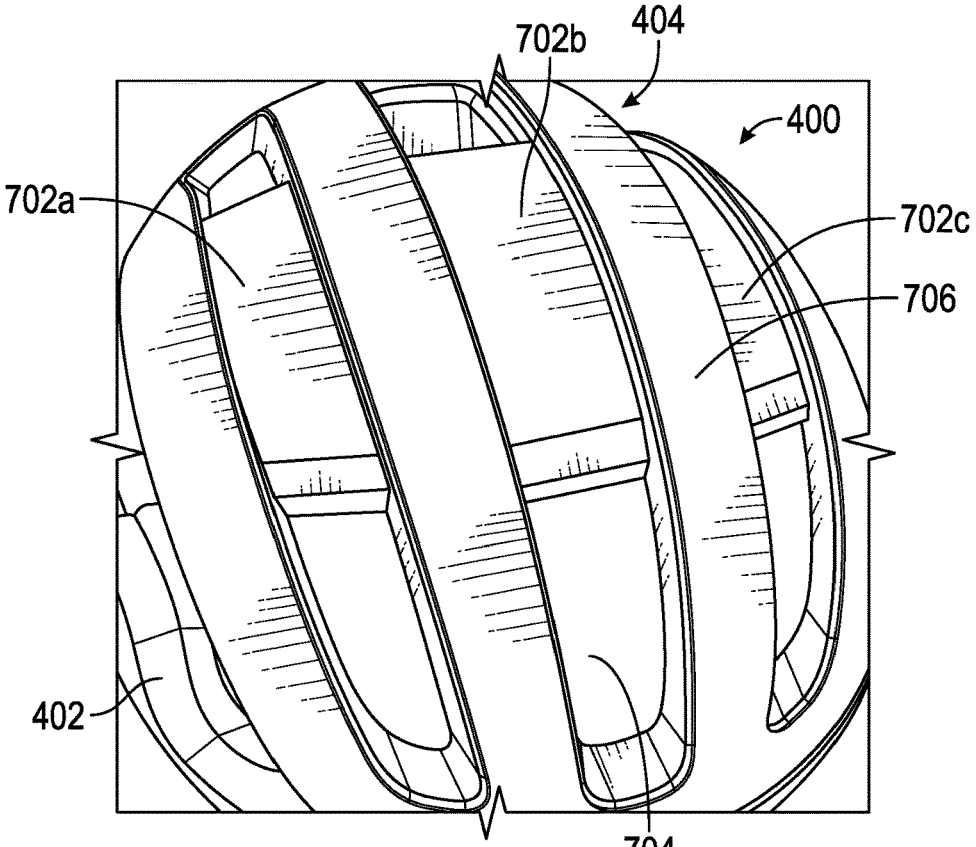

FIG. 7 is a top perspective view of the helmet 400 and shows one example implementation of at least one solar cell 702 integrated into the top of the helmet for charging the battery 304. In the illustrated example, the inner layers of the helmet include vents in the form of elongate openings 704 (only one labeled) that extend through the helmet that are designed to reduce weight and promote airflow through the helmet. The outer shell 404 includes a plurality of elongate portions 706 (only one labeled) that define the elongate openings 704 therebetween that are designed to align with elongate openings in the energy absorbing layer 402. The solar cell is 702 embedded in an outer surface of the energy absorbing layer 402. In the illustrated example, helmet 400 includes a single solar cell 702 disposed in the energy absorbing layer 402 and portions of the solar cell are covered by the outer shell elongate portions 706 leaving other portions 702*a*, 702*b*, 702*c* of the solar cell exposed to ambient light.

In the illustrated example, the solar cell 702 has a top surface that is substantially flush with the outer surface of the outer shell 404 to provide a fully integrated and flush fit. In the illustrated example, each exposed portion 702*a*, 702*b*, 702*c* of the solar cell extends in a front-rear direction across the midplane of the helmet and has a reduced length as compared to a length of the helmet in a front-rear direction to allow for openings 704 on either end of each solar cell.

Figure 8A:
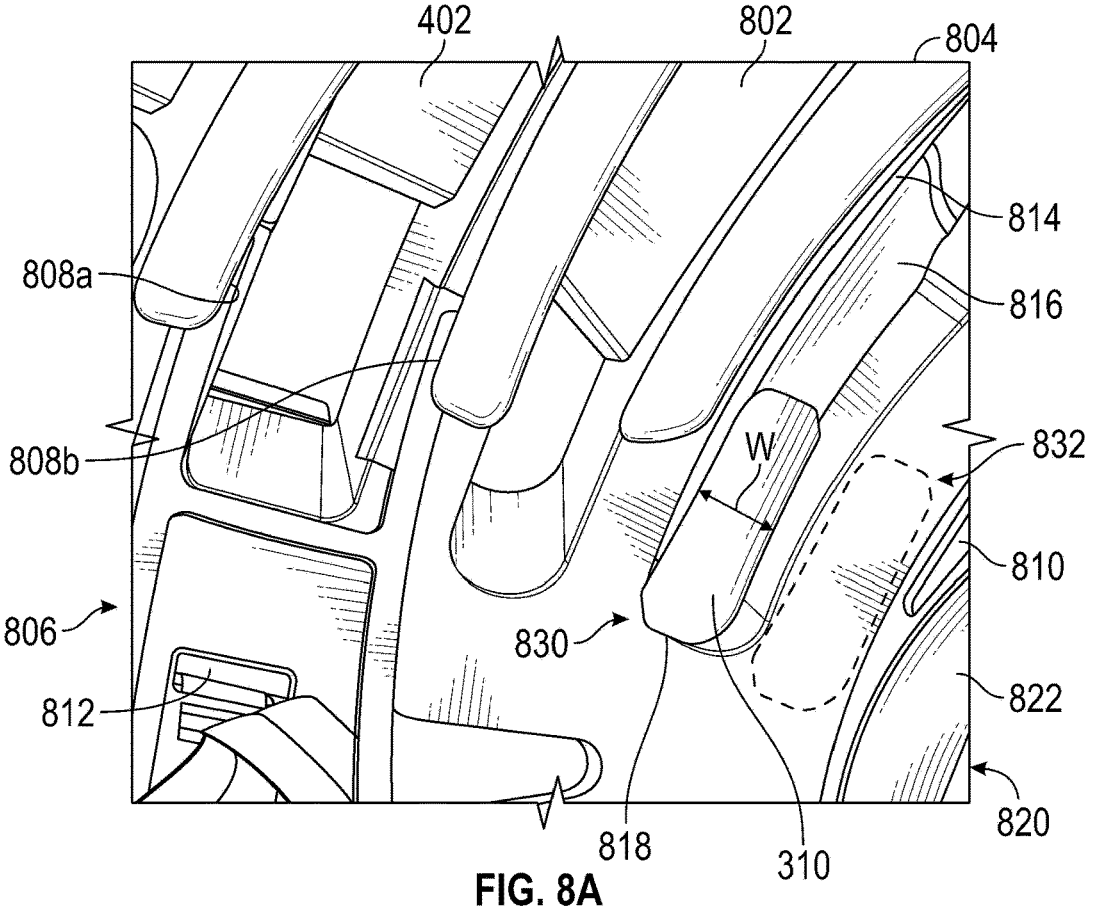

FIG. 8A is a perspective view of a portion of the interior of helmet 400 and shows the placement of one of the sensing plates 310 of the proximity sensor 106. FIG. 8A shows a portion of the parietal portion of the helmet 400 and shows the inner surface 802 of the helmet defined by the energy absorbing layer 402 (for example, EPS foam) and a plurality of comfort pads 804 (only one labeled) secured to the inner surface that are designed to improve fit, comfort and/or safety. FIG. 8A also shows portions of a fit system 806 including two center anchor points 808*a*, 808*b* and a lateral anchor point 810 where the fit system is secured to the helmet. FIG. 8A also shows a portion of a strap system including a plastic strap anchor 812 disposed in a strap anchor recess of the energy absorbing layer 402. In the illustrated example, the energy absorbing layer 402 includes a plurality of elongate ridges 814 (only one labeled) that define elongate recesses 816 (only one labeled) therebetween, with some of the recesses extending entirely through the thickness of the helmet and others having a depth that is less than the thickness of the helmet.

Figure 8B:
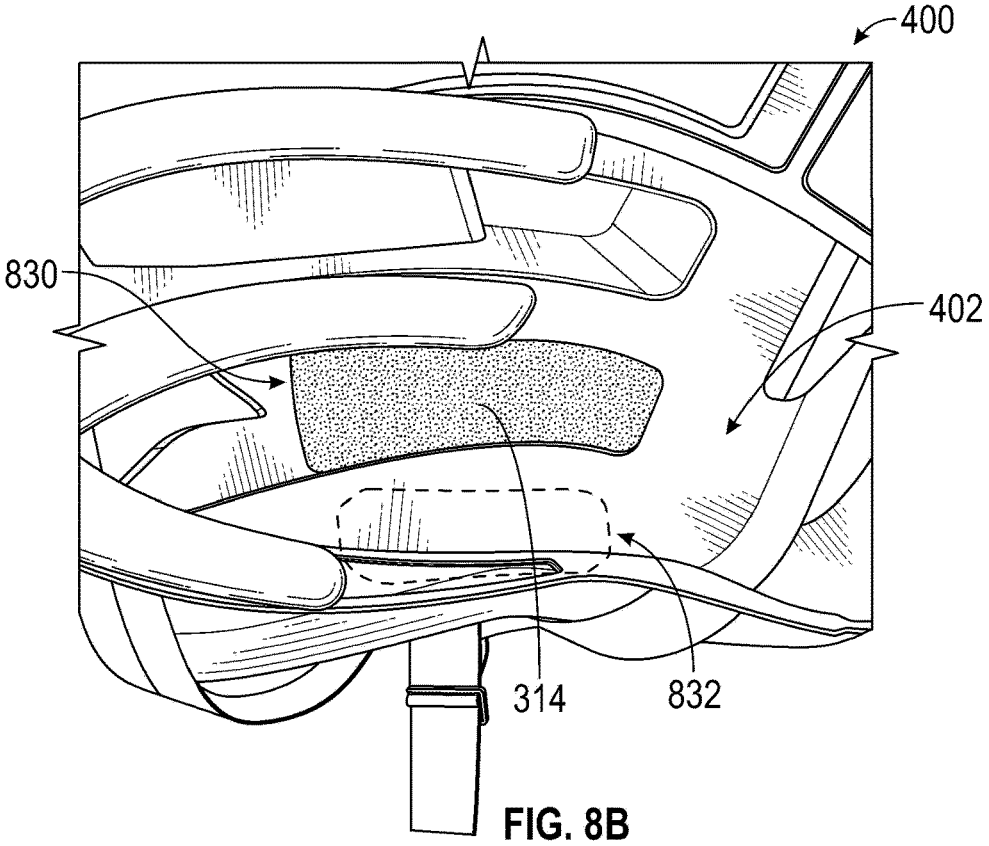

In the example shown in FIG. 8A, one of the sensing plates 310 of the proximity sensor is located at a first location 830 in one of the EPS foam layer elongate recesses 816 and has a width, w, that is approximately the same as a width of the elongate recess. In the illustrated example, the sensing plate 310 is located at a back end 818 of the energy absorbing layer elongate recess 816 in a parietal region of the helmet and above an ear portion 820 of the lower edge 822 of the helmet and designed to be located directly adjacent a parietal region of a user's head to maximize the effectiveness of the proximity sensor at reliably detecting the presence of a user's head. For ease of illustration, FIG. 8A shows the sensing plate 310 placed on the inner surface of the helmet. When fully assembled, however, the sensing plate 310 may be disposed in the energy absorbing layer 402 and not visible. For example, during manufacture of the helmet 400, the sensing plate 310 may be disposed in an injection mold prior to the injection of the energy absorbing material so the sensing plate is embedded in the energy absorbing material. In other examples, the sensing plate 310 may be disposed in recess 816 of the energy absorbing layer 402 and a cover such as one of the sensing plate covers 314 (FIG. 3B) may be placed over the sensing plate to hide it from view and/or prevent direct contact with the sensor. In other examples, the sensing plate 310 or other sensing plates or sensing elements may be located in other regions of the interior of the helmet than one of recesses 816 such as location 830. For example, FIG. 8A illustrates an alternate location 832 where one of sensing plates 310 may be located at an inner surface of energy absorbing layer 402. At alternate location 832, the sensing plate is not in one of the elongate recesses of the EPS foam later 402 and instead is located at a radially innermost location of the EPS foam layer. As with location 830, in location 832 the sensing plate may be disposed in the EPS foam layer or disposed on a surface of the EPS foam layer and covered by an insulating plate. In some examples, sensing plates may be located in both locations 830 and 832, or in another location in the helmet other than location 830 or 832. FIG. 8B shows one example of a sensing plate 310 disposed in an elongate recess 816 in the inner surface of the helmet 400 and covered by one of the sensing plate covers 314 of FIG. 3B such that the sensing plate is not visible.

Figure 9:
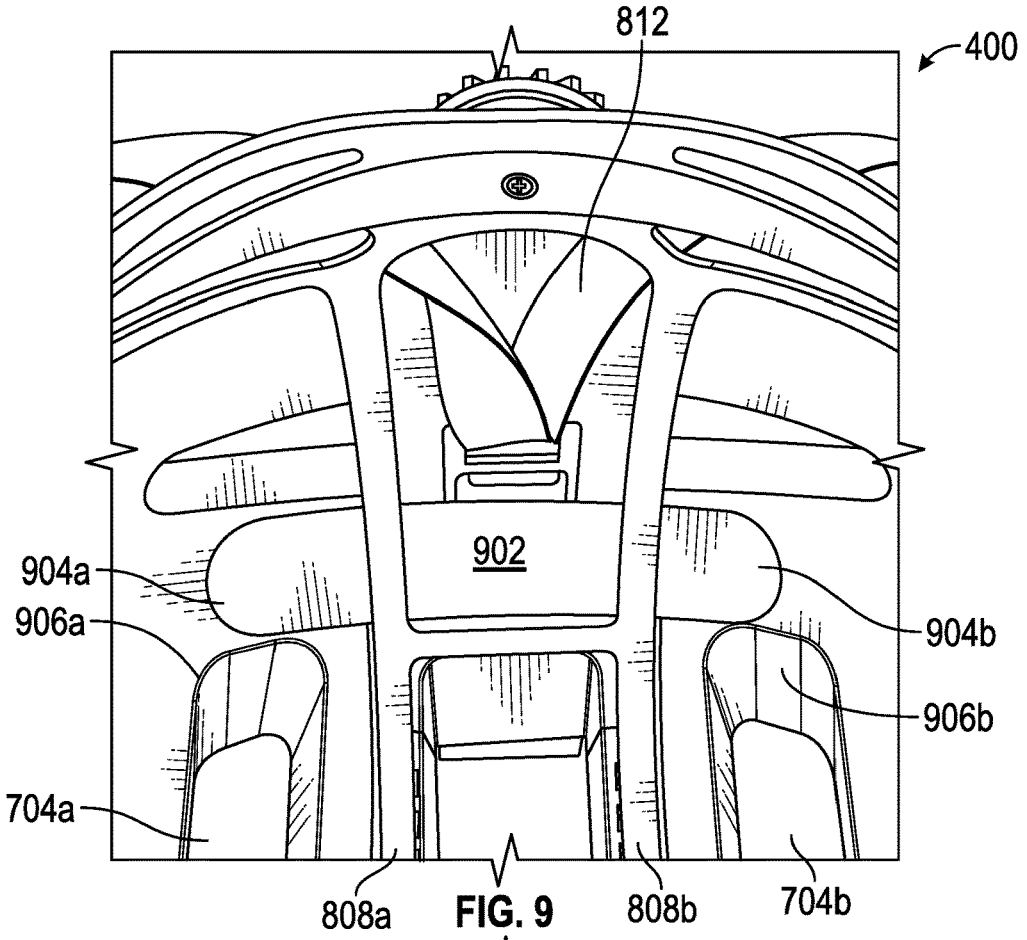
Figure 10:
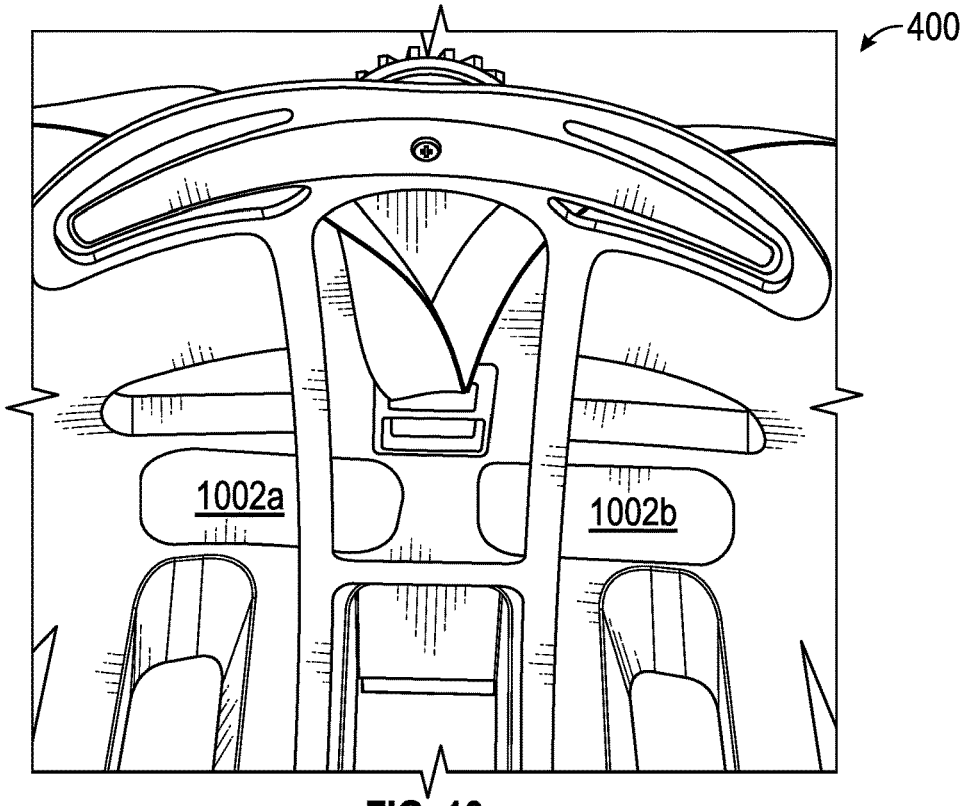

FIG. 9 shows another example of a sensing plate 902 and another example of placement of the sensing plate in the interior of the helmet 400. FIG. 9 shows a rear inner portion of helmet 400 and shows a single elongate sensing plate 902 arranged transverse to a front-rear centerline of the helmet so that a central longitudinal axis of the sensing plate is substantially perpendicular to the front-rear centerline of the helmet. FIG. 9 shows the sensing plate 902 located in the rear portion of the helmet proximate the parietal and occipital portions of the helmet and located between the center anchor points 808 of the fit system and the center anchor point 812 for the strap system. A first end 904*a* of the sensing plate 902 is located proximate a back end 906*a* of a first front-rear elongate vent hole 704*a* and second end 904*b* of the sensing plate is located proximate a back end 906*b* of a second front-rear elongate vent hole 704*b*. FIG. 10 shows an alternate example that is similar to the example shown in FIG. 9 except that two sensing plates 1002*a* 1002*b* are located in the same region of the helmet as the single sensing plate 902 in the example shown in FIG. 9. As with the example shown in FIGS. 8A and 8B, in the examples shown in FIGS. 9 and 10, when fully assembled, the sensing plates 902, 1002 may be embedded in the energy absorbing layer 402 or may be disposed on an inner surface of the energy absorbing layer and a cover may be placed over the sensing plate(s) to hide it from view and/or prevent direct contact with the sensing plate and provide a moisture barrier to prevent moisture from coming into contact with the sensing plate. The cover may be a rigid sheet of material and/or tape, adhesive, or sticker, etc.

Figure 11:
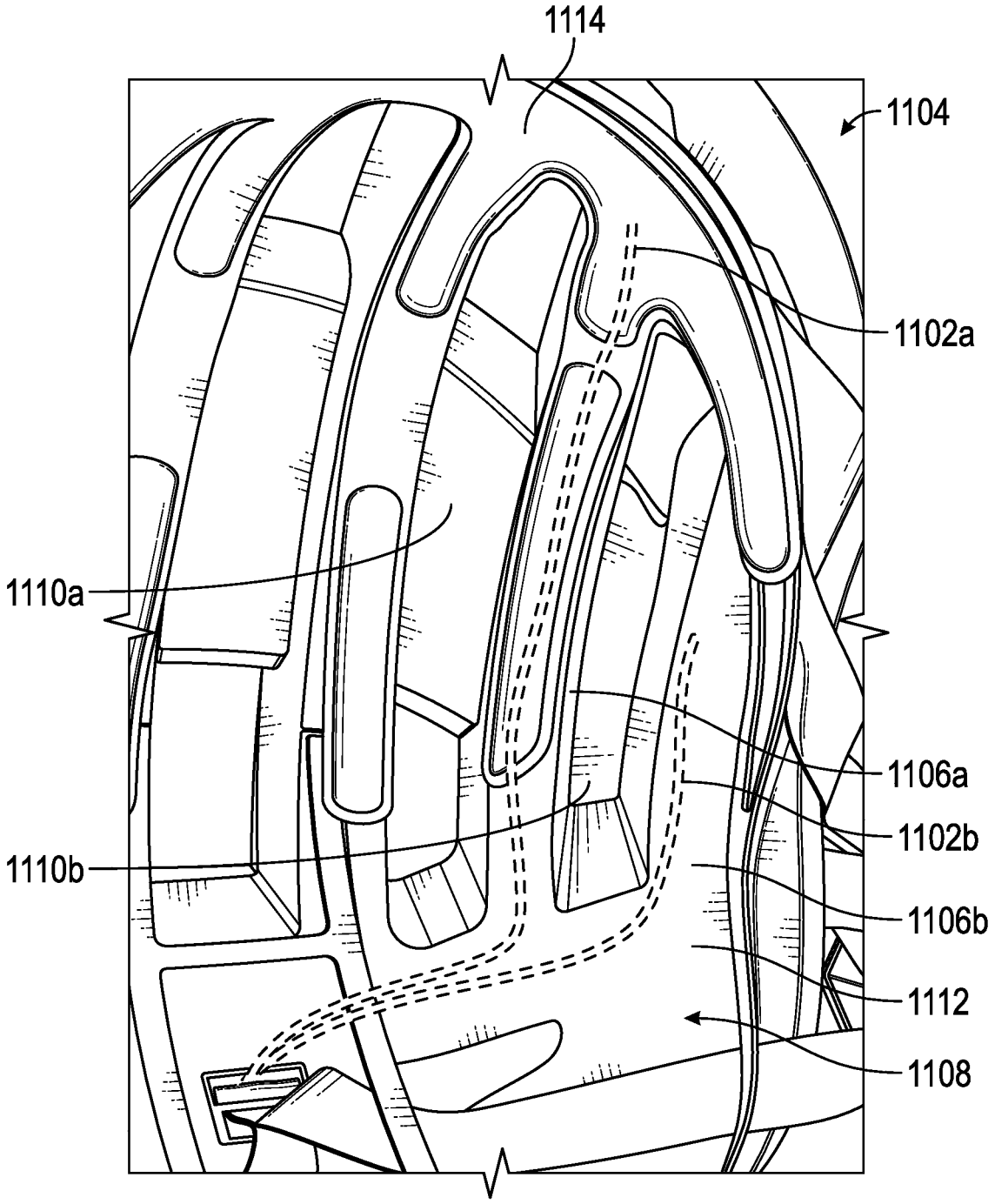

FIG. 11 illustrates an alternate example of a proximity sensor that includes sensing cables 1102*a*, 1102*b* instead of or in addition to sensing plates. FIG. 11 is a schematic illustrating two cables at two different locations on one side of a helmet 1104, each sensing cable 1102 located in an elongate ridge 1106 of energy absorbing material 1108 that is adjacent a recess 1110*a*, 1110*b* in the energy absorbing material 1108. As indicted by the broken lines, the sensing cables 1102 may be embedded in the energy absorbing layer 1108 or other inner layer or disposed on an inner surface 1112 of the energy absorbing layer and covered with a moisture blocking and insulating cover such as a flexible or rigid sheet of material. One or more comfort pads 1114 may be located on the inner surface 1112 of the energy absorbing layer 1108 where the sensing cable 1102 is located, the broken lines indicating the sensing cable is below the comfort pad, for example, embedded in the energy absorbing layer 1108 or under a cover attached to the energy absorbing layer. In some examples, the helmet 1104 may only include one of the two sensing cables 1102 shown in FIG. 11 and the helmet may also include at least one sensing cable on the opposite, right side of the helmet in the portion of the helmet not shown in FIG. 11. Cables 1102 are positioned substantially parallel to a longitudinal axis of the corresponding elongate ridge 1106 and include a sensing portion that emits an electrical field for capacitive sensing, wherein the sensing portion extends across at least 25%, or at least 50%, or at least 75%, or at least 90% of a length of the elongate ridge. In another example the cables 1102 may be located in another portion of the energy absorbing layer and/or another layer of the helmet and have a sensing portion with any of the foregoing ranges of lengths.

Figure 12:
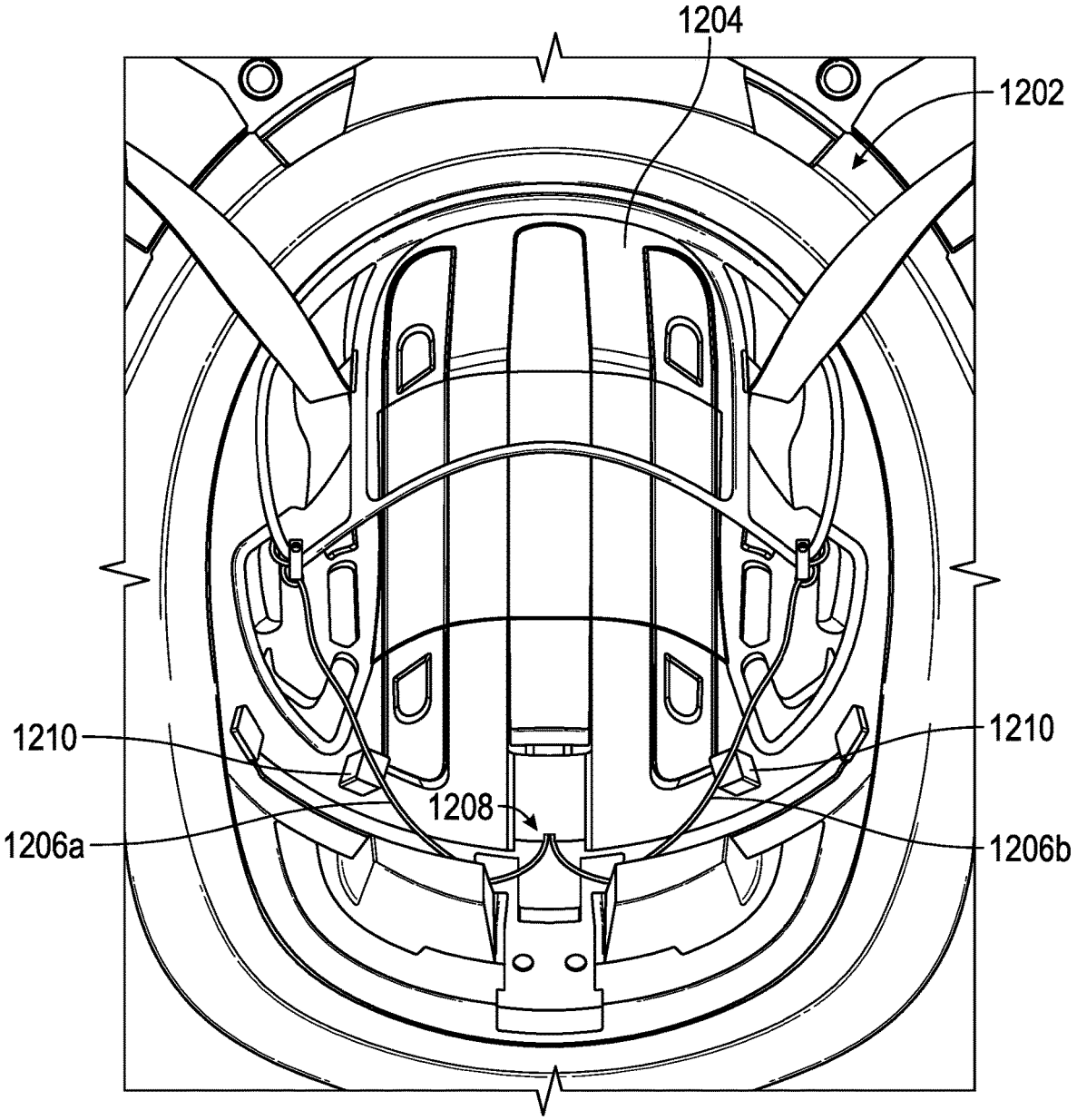

FIG. 12 shows a mold 1202 of an injection molding tool for forming a foam energy absorbing layer of a helmet. FIG. 12 also shows a polycarbonate outer shell 1204 for a helmet disposed in the mold before foam, for example, EPS, is injected and shows two sensing cables 1206*a*, 1206*b* of a capacitive sensor in place, with the cables routed through a location 1208 where the strap anchor opening of the foam layer will be formed and the cables extending in a front-rear direction along opposite sides of the helmet. As shown in FIG. 12, spacers 1210 may be used to locate the sensing cables 1206 proximate the inner surface of the foam layer, where a height of the spacer is designed and configured according to a predetermined thickness of the energy absorbing layer to locate the sensing cables at a submerged depth in the energy absorbing layer, the submerged depth designed and configured for detecting a presence of a user's head in the helmet via capacitive sensing. In other examples, one or more sensing plates (not illustrated in FIG. 12) may be placed in the mold tool in a similar manner prior to injection of the foam, for example, in any of the locations disclosed herein, resulting in embedded sensing plates.

Figure 13:
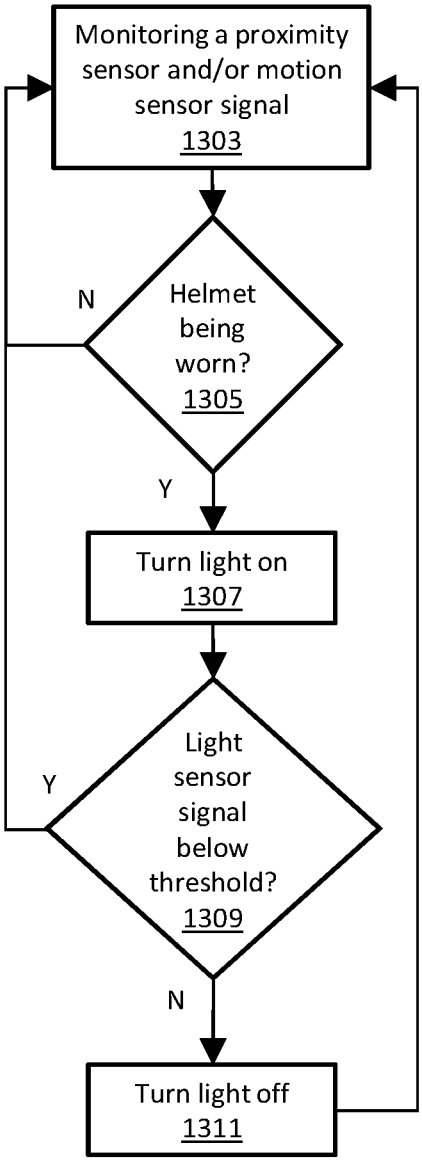

FIG. 13 is a flow chart showing one example method of operating a helmet lighting system made in accordance with the present disclosure, which may be performed by a controller of the lighting system. As shown, in the illustrated example, at step 1303, the method may include continuously monitoring a proximity sensor signal and/or motion sensor signal disposed in the helmet to determine whether or not the helmet is being worn. Step 1303 may include steps for maintaining adequate battery charge while monitoring the proximity and/or motion sensors. For example, the method may include first checking an energy level or state of charge of the battery and if the battery level is below a certain level, waiting a predetermined period of time, such as 30 seconds, before checking again. If the battery has sufficient charge, the step of monitoring the proximity and/or motion sensor may include checking a value of the signal and if the signal indicates the helmet is not being worn, waiting a predetermined period of time before checking again, for example, 1 second. At steps 1305 and 1307, in response to determining the helmet is being worn, automatically turning on at least one light source of the lighting system. In the illustrated example, the at least one light source is turned on whether or not an ambient light sensor indicates ambient lighting is below a threshold value, which can provide a positive indication to the user that the lighting system is functioning. At step 1309, after turning the light source on, the method may include determining whether an ambient light sensor signal is below a threshold value thereby indicating the ambient lighting is below a threshold lighting level and lighting is needed or desirable, and if yes, keeping the light on and returning to step 1303 and if not, indicating the ambient lighting is above the threshold lighting level and lighting is not needed, at step 1311 turning the light off and returning to step 1303. In some examples, the method may also include preventing the draining of the battery due to a false sensor reading by starting a timer when the light is first turned on and the light sensor signal is below the threshold and checking the value of the timer in each iteration of the method and turning the light off when the timer reaches a predetermined value, such as two hours, indicating the proximity sensor and/or motion sensor are providing a false reading and the helmet is no longer being worn.

In some examples, the ambient light sensor may be in close proximity to one or more of the light sources such that the light source may affect the ambient light sensor signal when the light source is on. In cases where the light source may affect the ambient light sensor, step 1307 may include turning the light source on in an intermittent flashing mode that includes turning the light source on and off and step 1309 may include only comparing ambient light signal values to the threshold value during the periods when the light source is off. Such a method provides a variety of advantages including a compact arrangement where the light source and light sensor are in close proximity, allowing for the light source to be immediately powered on before the ambient light is measured, and also allowing for ambient light measurements after powering on the light source.

In other examples, steps 1309 and 1307 may be reversed and the light may be turned on only after the proximity sensor indicates the helmet is being worn the ambient light sensor signal has been measured. In some examples, the light may still be turned on whether or not the ambient light sensor signal is above or below a threshold value to provide a positive indication the light system is functioning, but then turn off after a short period of time, for example turn off after being on for 3-5 seconds, if the light sensor signal is above the threshold, while remaining on if the light sensor signal is below the threshold. In yet other examples, step 1309 may be omitted, and the method may include keeping the light source on at all times the helmet is being worn without consideration of ambient light conditions. In yet other examples, the method may include keeping the light source on at all times the helmet is being worn until a state of charge or energy level of the battery falls below a threshold value and then after the battery energy level falls below the threshold value, only keeping the light source on if ambient light is below a threshold value and then finally turning the light off when the battery level reaches a critical low level, where if the battery energy level or charge fell below the critical low level the battery would be damaged. In other words, the method may include keeping the light on at all times when sufficient battery power is available but if battery power becomes low, such as below a half charge or quarter charge, only turning the light on when ambient light is low, and lighting is most needed.

Methods of the present disclosure may also include a method of controlling a helmet lighting system with a controller according to instructions stored in a non-transitory computer readable storage medium, the instructions including: continuously monitoring a proximity sensor signal; in response to the proximity sensor signal indicating the presence of a user's head, turning the light source on in a flashing light mode; monitoring a light sensor signal to determine ambient lighting conditions, wherein the determining includes only considering a value of the light sensor signal during the off portions of the flashing light mode; turning the light source off when the light sensor signal during the off portions indicates the ambient light is above a threshold value indicating lighting is not needed, otherwise leaving the light source on while the ambient light sensor signal is below the threshold value until a maximum time duration is reached or a critical low battery level is reached. If the light was turned off while the helmet is still being worn, continuously monitoring the light sensor signal while the proximity sensor signal indicates the helmet is being worn; and turning the light source on in response to the light sensor signal during the off portions dropping below the threshold value indicating lighting is needed.

In some examples the method may include changing an illumination characteristic of the light source when vehicle headlights from an oncoming vehicle are detected. For example, when the lights are on, in response to a sudden increase in light measured by the light sensor indicating headlights of an oncoming vehicle, the method may include changing an operating mode of the light source from a first mode to a second mode, such as from a constant light to a flashing light to make the user more noticeable to the operator of the oncoming vehicle.

The foregoing has been a detailed description of illustrative embodiments of the disclosure. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this disclosure. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure.

What is claimed is:

1. A helmet, comprising:

an energy absorbing layer having an inner surface;

at least one electrical component coupled to the helmet;

at least one capacitive proximity sensor electrode disposed proximate the inner surface of the energy absorbing layer; and a controller electrically connected to the at least one electrical component and the at least one electrode, the controller configured to generate an electric field at the electrode and receive a proximity sensor signal that detects when the helmet is being worn by detecting a change in the electric field caused by the presence of a user's head inside of the helmet, wherein the controller is configured to activate and deactivate the at least one electrical component according to the proximity sensor signal;

wherein the at least one electrical component includes a lighting system that includes a lighting module disposed on an outer surface of the helmet that includes at least one light emitting element, the controller is configured to activate the at least one light emitting element when the proximity sensor signal indicates the helmet is being worn; wherein the lighting system includes an ambient light sensor, the controller is configured to activate the at least one light emitting element when the proximity sensor signal indicates the helmet is being worn and the ambient light sensor indicates ambient light is below a threshold value; and wherein the controller is configured to activate the at least one light emitting element in an intermittent flashing mode and compare a signal of the ambient light sensor to the threshold value during time periods of the intermittent flashing mode when the at least one light emitting element is off to determine whether to activate the at least one light emitting element.

2. The helmet of claim 1, wherein the energy absorbing layer includes an injection molded foam material, wherein the at least one electrode is embedded in the foam material.

3. The helmet of claim 1, wherein the at least one electrode is disposed on the inner surface of the energy absorbing layer and encased between the inner surface and a sheet of insulating material.

4. The helmet of claim 1, wherein the at least one electrode is a conductive plate or a conductive cable.

5. The helmet of claim 4, wherein the conductive plate is a metal foil.

6. The helmet of claim 5, wherein the metal foil has a thickness in the range of approximately 0.1 mm to approximately 2 mm.

7. The helmet of claim 1, wherein the inner surface of the energy absorbing layer includes at least one recess, wherein the at least one electrode is located in the at least one recess.

8. The helmet of claim 7, wherein the at least one electrode has a width that is substantially the same as a width of the at least one recess.

9. The helmet of claim 8, wherein the energy absorbing layer includes a plurality of elongate ridges and wherein the at least one recess includes a plurality of elongate recesses located between corresponding ones of the elongate ridges.

10. The helmet of claim 9, further comprising at least one comfort pad located on one of the elongate ridges.

11. The helmet of claim 1, wherein the energy absorbing layer includes a plurality of elongate ridges, wherein the at least one electrode is located along one of the elongate ridges.

12. The helmet of claim 11, wherein the at least one electrode is a cable that is positioned substantially parallel to a longitudinal axis of the elongate ridge and includes a sensing portion that emits the electrical field, wherein the sensing portion extends across at least 25% of a length of the elongate ridge.

13. The helmet of claim 12, wherein the sensing portion extends across at least 50% or at least 75% or at least 90% of the length of the elongate ridge.

14. The helmet of claim 1, wherein the helmet includes a front end, a rear end, a left side, a right side, a lateral midplane extending between the left side and the right side and located at a midpoint between the front and rear ends, a longitudinal midplane extending between the front end and rear end and located at a midpoint between the left side and the right side, and a parietal portion extending rearward of the lateral midplane that is designed to cover and be adjacent to a parietal portion of a user's head.

15. The helmet of claim 14, wherein at least a portion of the at least one electrode is located adjacent the lateral midplane and/or is located in the parietal portion.

16. The helmet of claim 15, wherein the at least one electrode includes first and second electrodes located on opposite sides of the longitudinal midplane.

17. The helmet of claim 1, wherein the energy absorbing layer includes an outer surface and a recess located in the outer surface, wherein the controller is at least partially disposed in the recess, further comprising at least one wire extending through the energy absorbing layer from the controller to the at least one electrode to electrically connect the controller to the at least one electrode.

18. The helmet of claim 17, wherein the controller and the at least one electrode are located in the parietal portion of the helmet.

19. The helmet of claim 1, further comprising a motion sensor, wherein the controller is configured to activate the at least one electrical component when the proximity sensor signal and the motion sensor indicate the helmet is being worn and deactivate the at least one electrical component when the proximity sensor signal has indicated the helmet is being worn for a time period that is greater than a threshold time period or when the motion sensor indicates the helmet is not being worn.

20. The helmet of claim 1, wherein the ambient light sensor is located in the lighting module.

21. The helmet of claim 1, further comprising a battery for powering the controller and at least one electrical component, and at least one solar cell electrically connected to the battery for charging the battery, the at least one solar cell embedded in the helmet and located adjacent an outer surface of the helmet.

22. The helmet of claim 21, wherein the helmet includes an outer shell that includes at least one opening, the at least one solar cell located in the at least one opening.

23. The helmet of claim 21, wherein the helmet includes an outer shell that includes a plurality of elongate portions extending in a longitudinal direction that define a plurality of elongate openings therebetween, the helmet further including a plurality of vents defined by portions of the elongate openings and openings in the energy absorbing layer, wherein the at least one solar cell is located in at least one of the elongate openings of the outer shell.

24. The helmet of claim 23, wherein the at least one solar cell extends across at least two of the elongate openings with a portion of the outer shell covering a portion of the solar cell.

25. The helmet of claim 21, wherein the helmet does not include an external charging port for recharging the battery and the at least one solar cell is the only energy source for recharging the battery.

26. The helmet of claim 25, wherein the helmet is fully automated and does not include any user control elements for activating or controlling the at least one electrical component.

27. The helmet of claim 1, wherein the capacitive proximity sensor is a mutual-capacitive sensor or a self-capacitive sensor.

28. A method of controlling a helmet lighting system of a helmet with a controller embedded in the helmet according to instructions stored in a non-transitory computer readable storage medium, the instructions including:

providing an electrical current to an electrode of a capacitive proximity sensor to generate an electric field at the electrode, the electrode located proximate an inner surface of the helmet;

receiving a proximity sensor signal that detects when the helmet is being worn by detecting a change in the electric field caused by the presence of a user's head inside of the helmet;

turning a light source of the lighting system on in response to the proximity sensor signal indicating the presence of a user's head in the helmet and an ambient light sensor signal of an ambient light sensor coupled to the helmet below a threshold value; wherein the step of turning the light source on includes turning the light source on in a flashing light mode;

turning the light source off when the ambient light sensor signal during off portions of the flashing light mode indicate the ambient light is above the threshold value; and keeping the light source on when the ambient light sensor signal during the off portions is below the threshold value.

29. The method of claim 28, further comprising:

turning the light source off in response to the proximity sensor signal indicating the presence of a user's head in the helmet and the ambient light sensor signal being above the threshold value;

continuously monitoring the ambient light sensor signal while the proximity sensor signal indicates the presence of a user's head in the helmet; and turning the light source on in response to the ambient light sensor signal falling below the threshold value while the helmet is being worn.

* * * * *